US006257665B1

(12) United States Patent
Nagamitsu et al.

(10) Patent No.: US 6,257,665 B1
(45) Date of Patent: Jul. 10, 2001

(54) CHAIR

(75) Inventors: Satoshi Nagamitsu, Tokyo; Hiroshi Masunaga, Yokohama, both of (JP)

(73) Assignee: Okamura Corporation (JP)

( * ) Notice: Subject to any disclaimer, the term of this patent is extended or adjusted under 35 U.S.C. 154(b) by 0 days.

(21) Appl. No.: 09/342,574

(22) Filed: Jul. 8, 1999

(30) Foreign Application Priority Data

Jul. 9, 1998 (JP) ..... 10-193871
Jun. 6, 1999 (JP) ..... 11-098811
Jun. 6, 1999 (JP) ..... 11-098812
Jun. 6, 1999 (JP) ..... 11-098813

(51) Int. Cl.[7] ..... A47C 3/00; A47C 3/021; A47C 3/12

(52) U.S. Cl. ..... 297/285; 297/452.15; 297/440.2; 297/DIG. 2; 297/354.1

(58) Field of Search ..... 297/440.2, 354.1, 297/285, DIG. 2, 440.22, 452.15

(56) References Cited

U.S. PATENT DOCUMENTS 4,892,356 * 1/1990 Pittman et al. ..... 297/DIG. 2
5,114,210 * 5/1992 Naess ..... 297/285
5,597,203 1/1997 Hubbard .
5,599,069 * 2/1997 Lobiecki ..... 297/452.15
5,704,688 * 1/1998 Schrewe et al. ..... 297/285 X

FOREIGN PATENT DOCUMENTS

WO 96/25072 8/1996 (WO) .

* cited by examiner

*Primary Examiner*—Anthony D. Barfield
(74) *Attorney, Agent, or Firm*—Zarley, McKee, Thomte, Voorhees & Sease

(57) ABSTRACT

A chair comprises a back cushion material, a back plate and a back frame. The chair is used for looking at a display of a personal computer at suitable posture when it is reclined. The back plate comprises upper and lower shell which are connected by a flexible bent portion to each other. The back plate is mounted to the back frame at the upper end and a lower portion. When the chair is reclined, the upper shell is moved forwards and the lower shell is moved rearwards, so that an angle between the upper and lower shells may become smaller. Thus, the operator can take suitable posture for looking at the display any time.

16 Claims, 17 Drawing Sheets

CHAIR

BACKGROUND OF THE INVENTION

The present invention relates to a chair, and especially, to a chair suitable for operation of office automation equipment such as a personal computer and keeping stable posture in reclining of an operator.

There is a known chair which has a device for inclining or a seat or the back to support a human body suitably depending on various postures in desk working by office automation equipment such as a personal computer.

In such chairs, an upper portion of the back is kept at the same angle as backward inclination whenever the back is inclined rearwards, or a parallelolink mechanism is included in which an upper portion of the back is always inclined regardless of a reclining angle of the back.

However, in the former chair, when inclined rearwards, a position of one's head is moved rearwards, thereby making it difficult to look at a display of the personal computer. When one is leaned over the back, one's eye is directed upwards. It is said to be suitable as an angle for looking at a monitor display on a desk that one's eye is directed downwards at 5 to 10° . To take such posture in a conventional chair, one's head must be raised upwards, which causes stiff back or weariness in neck.

When one's head is raised forwards forcibly, the back of the human body does not fit with the back of the chair, and the human body is separated from the back of the chair, so that one's posture is placed in unstable situation. Thus, one could not take stable posture and will be tired.

In the latter chair, regardless of reclining angle of the back of the chair, the upper portion of the back must be kept at the same angle. Thus, when the back of the chair is reclined, the person will be humpback and placed under pressure.

To prevent a gap between the back of a human body and the back of the chair in backward posture to cause backache, International Pub. No. WO96/125072 discloses a chair in which the back and buttocks are independently supported regardless of inclination of the backbone or sitting posture. However, buttocks and back receivers are independently inclined by respective mechanism, so that fitness of the back and buttocks of the human body to the back of the chair is lost. Also, the inclining mechanism becomes complicate and is expensive.

SUMMARY OF THE INVENTION

In view of the foregoing disadvantages, it is a principal object of the invention to provide a chair to keep suitable posture of a human body at any time when one's posture is varied during working.

It is another object of the present invention to provide a chair to take relaxed posture for looking at a display of a personal computer in office automation equipment.

It is further object of the present invention to provide a chair in simple structure to support the back and buttocks of a human body by a lower portion of the back of the chair without a gap therebetween in backward inclination.

To achieve the objects, according to the present invention, there is provided a chair which comprises a back frame; and a back plate which comprises upper and lower shells, an upper end of the upper shell and a lower portion of the lower shell being mounted to an upper end and a lower portion of said back frame, said upper shell being connected to said lower shell by a flexible bent portion, backward force being applied to the back plate when the chair is reclined, to move the upper shell forwards and the lower shell backwards, whereby an angle between the upper and lower shells may become smaller to keep posture of a sitting person suitable When the sitting person is inclined in reclining posture, backward inclination angle of the upper shell becomes smaller than backward inclination angle of the back frame, and backward inclination angle of the lower shell becomes larger than backward inclination angle of the back frame. Thus, when one looks at a display of a personal computer, one can take suitable posture by raising one's head and inclining one's back rearwards.

BRIEF DESCRIPTION OF THE DRAWINGS

The features and advantages of the present invention will become more apparent from the following description with respect to embodiments shown in the appended drawings wherein.

DETAILED DESCRIPTION OF PREFERRED EMBODIMENTS

Figure 1:
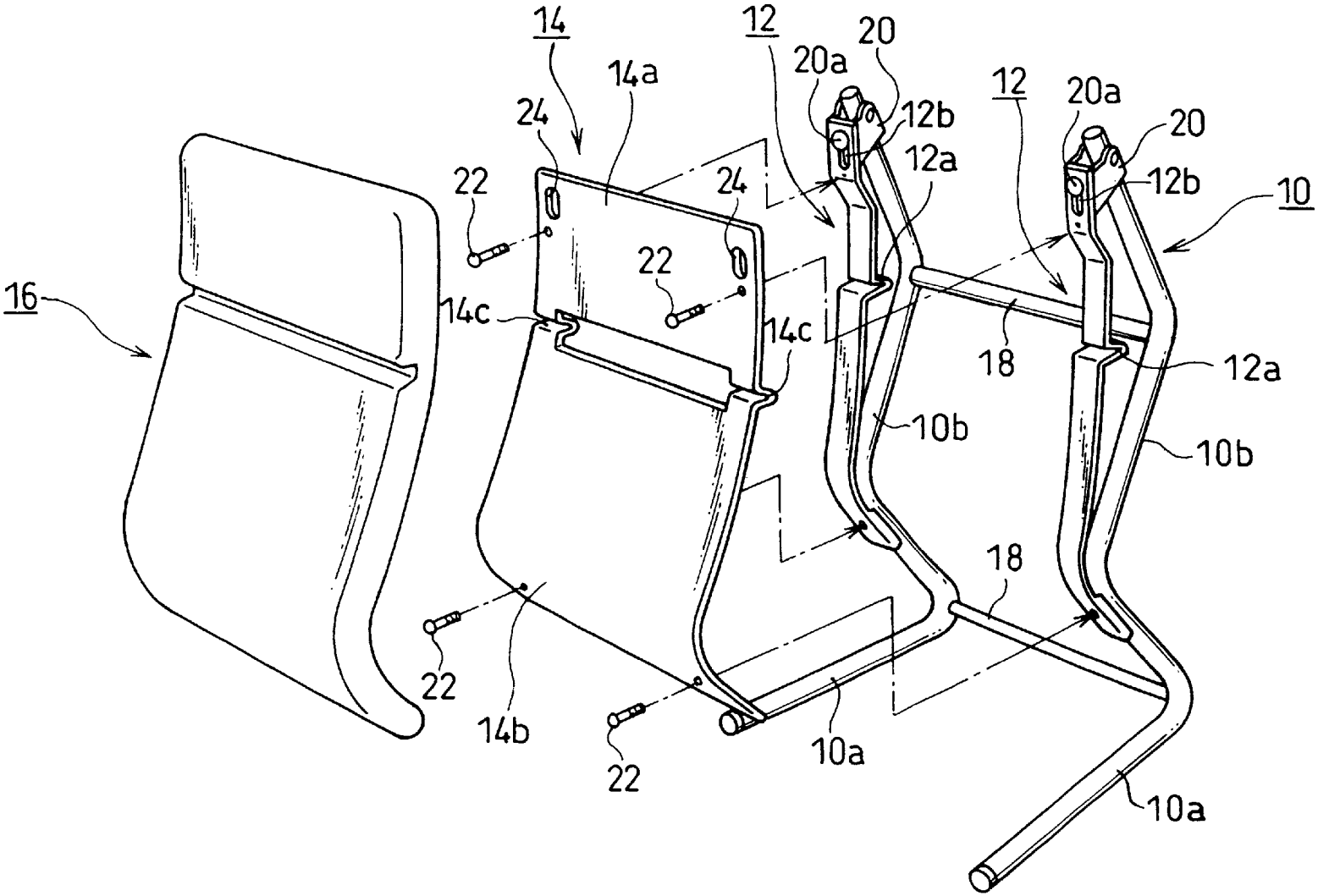
FIG. 1 is an exploded perspective view of the first embodiment of a chair according to the present invention.

FIG. 1 is an exploded perspective view of the back of a chair in the first embodiment according to the present invention. The back of the chair comprises a back frame 10, a pair of reinforcement members 12,12, a back plate 14 and a back cushion material 16. The back frame 10 comprises a pair of pipes which have horizontal bar portions 10*a* which extend forwards. The end thereof is mounted to a seat plate (not shown) and the frame 10 can be inclined rearwards around a support as a fulcrum.

Vertical bar portions 10*b* are bent at two points and connected to each other at upper and lower positions via two parallel cross rails 18,18. Along the vertical bar portions 10*b* of the back frame 10, a pair of flexible reinforcement members 12,12 is mounted At the upper ends of the upper vertical portions 10*b*, a pair of brackets 20,20 is pivotally mounted to the frame 10, and a guide pin 20*a* which has a flange is projected on each of the bracket 20. The guide pin 20*a* is engaged in an elongate guide bore 12*b* of the reinforcement member 12, so that the upper portion of the reinforcement member 12 is vertically slidable within a determined range.

The reinforcement member 12 is made of elastic material such as resin and the upper and lower portions of the back frame 1 are connected with a certain tensile strength. Folded portions 12*a* are formed in the middle of the reinforcement members 12,12, and folded portions 14*c*,14*c* of the back plate 14 are engaged in the folded portions 12*a*,12*a* to mount the back plate 14 to the reinforcement member, so that the reinforcement member 12 is bendable with the back plate 14 at the same height.

The back plate 14 comprises upper and lower shells 14*a*,14*b* at each side of the folded portions 14*c*,14*c* to provide flexibility. The lower shell 14*b* and the upper shell 14*a* are mounted to the reinforcement member 12 by set screws 22, thereby putting the reinforcement member 12 between the back plate 14 and the back frame 10.

Elongate bores 24 are formed at the upper end of the upper shell 14*a*, and the guide pins 20*a* are engaged in the bores 24. Thus, the reinforcement members 12 are moved up and down together with the back plate 14.

The back plate 14 has the same curve as the rear surface of the back cushion material 16. Backward force is applied to the lower shell 14*b*, so that the upper shell 14*a* is elastically inclined forwards over the folded portion 14*c*.

The back cushion material 16 is connected on the back plate 14 by any means to form the back of the chair.

Figure 2:
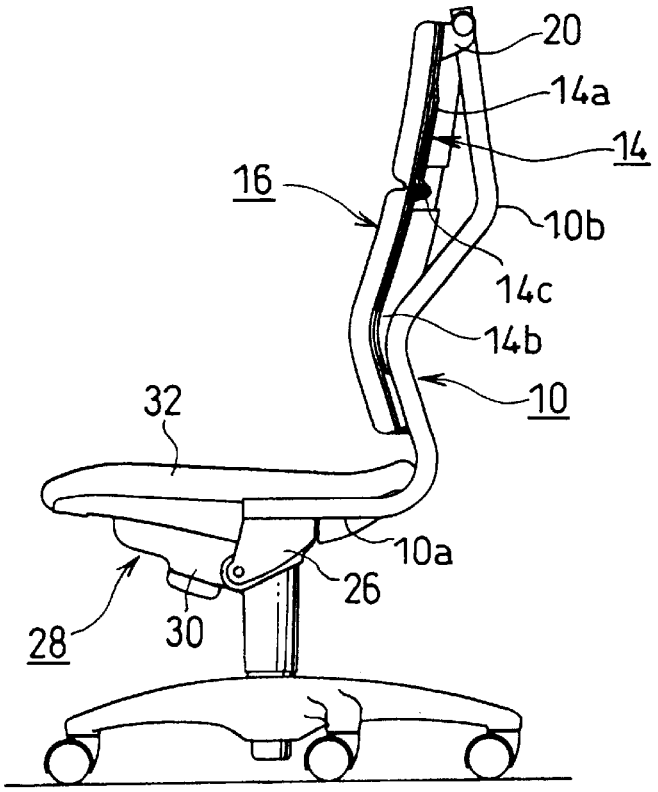
FIG. 2 is a side elevational view thereof.

FIG. 2 is a side elevational view which illustrates of the whole chair which includes the back. As shown in FIG. 2, the horizontal rod portion 10*a* of the back frame 10 is connected to a support 30 of a seat plate 28 by a mounting member 26 so that the seat plate 28 may be inclined. A seat cushion 32 is mounted on the seat plate 28.

The chair will be functioned as below.

Figure 3:
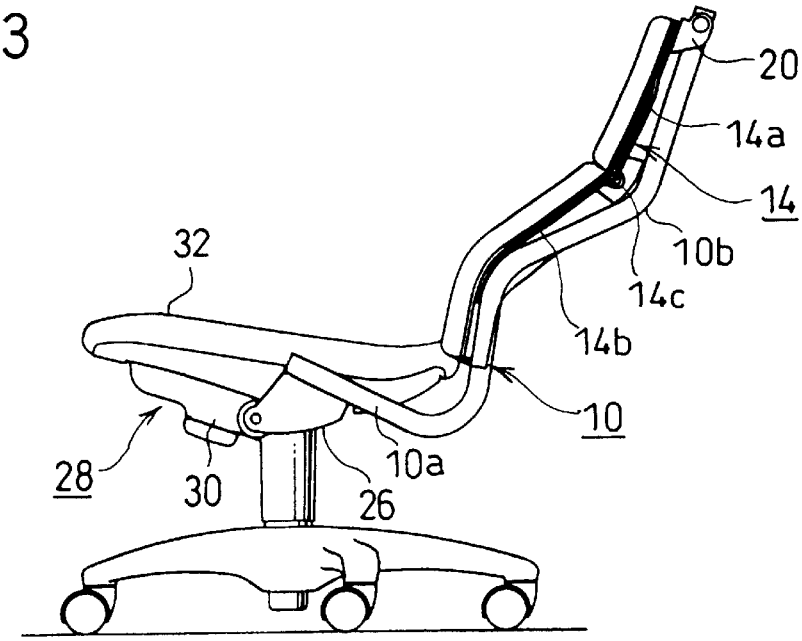
FIG. 3 is a side elevational view thereof in which the back of the chair is inclined rearwards.

FIG. 3 illustrates that the back of the chair is inclined rearwards. When the back itself is inclined rearwards, force is applied to the lower shell 14*b* of the back plate 14, and the lower shell 14*b* is inclined rearwards around the support 30. With backward movement of the lower shell 14*b*, the guide pin 20*a* is guided in the guide bore 12*b* to slide the reinforcement member 12 downwards. Further load is applied, so that the guide pin 20*a* is engaged on the upper inside of the guide bore 12*b* and the reinforcement member 12 is bent at the folded portion 12*a*.

Figure 4:
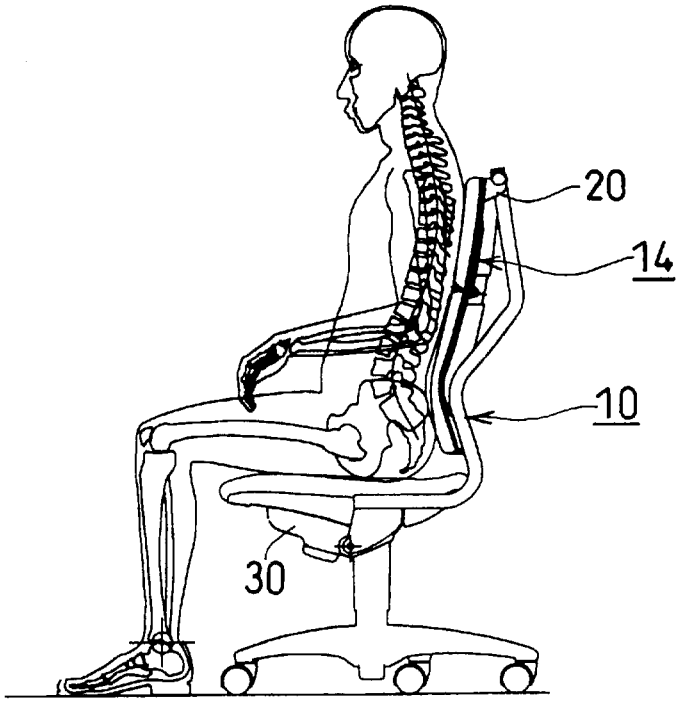
FIG. 4 is a side elevational view of the chair on which a person sits.

Then, as the folded portion 12*a* of the reinforcement member 12 is bent, the upper shell 14*a* of the back plate 14 is inclined forwards with respect to the lower shell 14*b* at the folded portion 14*c* to push the upper portion of the back cushion material 16 forwards. When usual upright posture of a sitting person in FIG. 4 is changed to posture in FIG. 5, the upper back of the person is pushed forwards and supported by the back cushion material 16.

In the embodiment of the chair according to the present invention, depending on degree of backward inclination of the person, an angle of forward inclination of the upper shell 14*a* is changed to push the upper portion of the back cushion material 16 forwards and to support the upper back of the person so as to take an optimum angle for the person. Thus, for example, when a personal computer is used, relaxed posture can be easily taken when one looks at a monitor display with the forwardly raised head, one's lower portion than the back being inclined rearwards.

Figure 5:
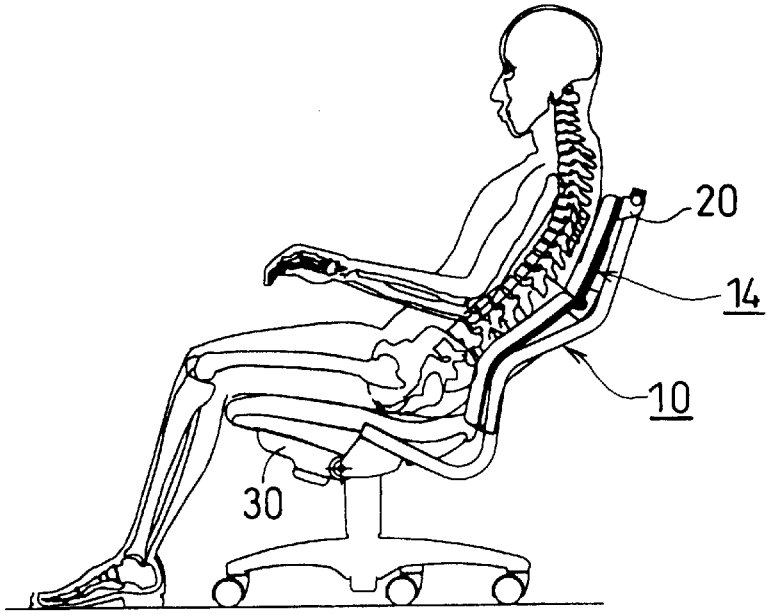
FIG. 5 is a side elevational view thereof in which the back of the chair is inclined rearwards.

In this embodiment, as shown in FIG. 5, when he is inclined rearwards, the upper shell 14*a* is inclined forwards to push and support one's back, so that one's eye is kept substantially horizontal. Thus, one can easily take posture in which one looks at the monitor display downwards by five to ten degrees under horizontal surface. The posture is suitable for looking.

Depending on the degree of backward inclination, an angle at which the upper shell 14*a* is bent forwards is changed, natural comfortable sitting can be obtained, and the rear cushion material 16 smoothly follows change in posture, thereby realizing comfortable sitting by fitting with curve of the back.

Figure 6:
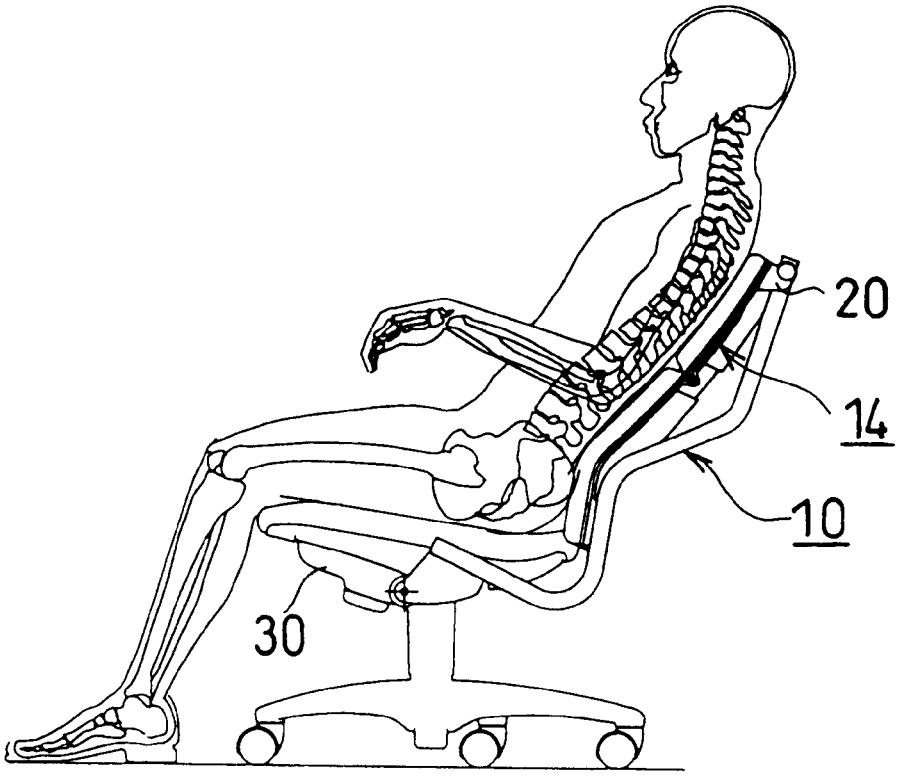
FIG. 6 is a side elevational view in which the back of the chair is further inclined rearwards and the back of the person is stretched straight.

As shown in FIG. 6, when one's back is changed to upright posture from inclined posture in FIG. 5, the upper shell 14*a* is smoothly inclined rearwards to follow movement of one's back, thereby taking more comfortable posture for the person easily and decreasing weariness even if he sits on the chair for a long time.

The reinforcement member 12 is provided at each side of the chair, and the back plate 14 provides good followabililty to horizontal weight balance of the person. The chair is compatible with posture change during operation of a personal computer. Further, fittings are gathered at the upper rear portion of the chair, thereby lightening the chair and providing beautiful design.

In the embodiment, the reinforcement member 12 is provided between the back plate 14 and the back frame 10. Similar advantages could be achieved by only the back plate 14 without the reinforcement member 12.

In this embodiment, both the reinforcement member 12 and the back plate 14 are slidably mounted to the upper end of the back frame 10, but one of them may be slidably mounted.

Figure 7:
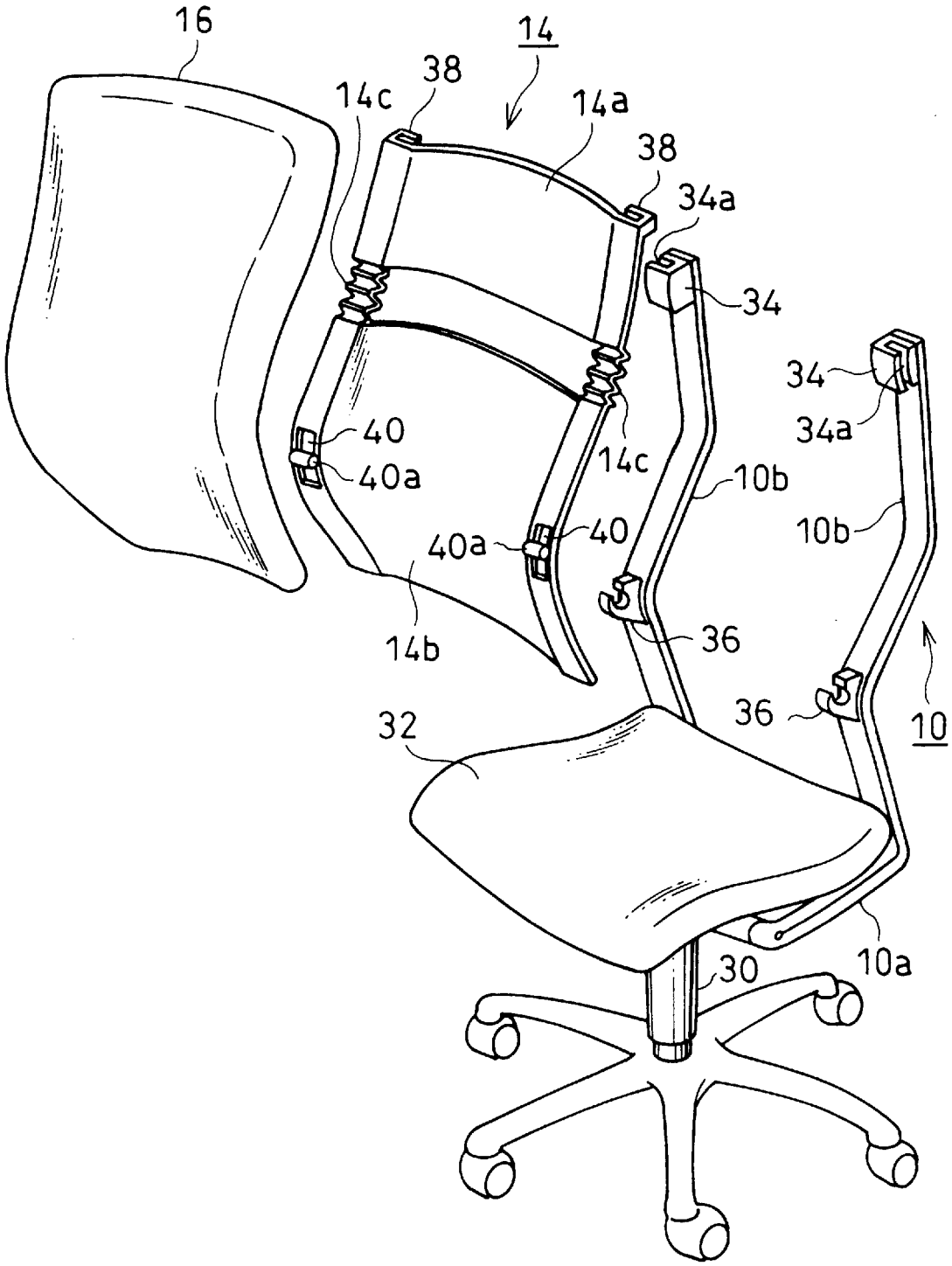
FIG. 7 is an exploded perspective view of the second embodiment of a chair according to the present invention.
Figure 8:
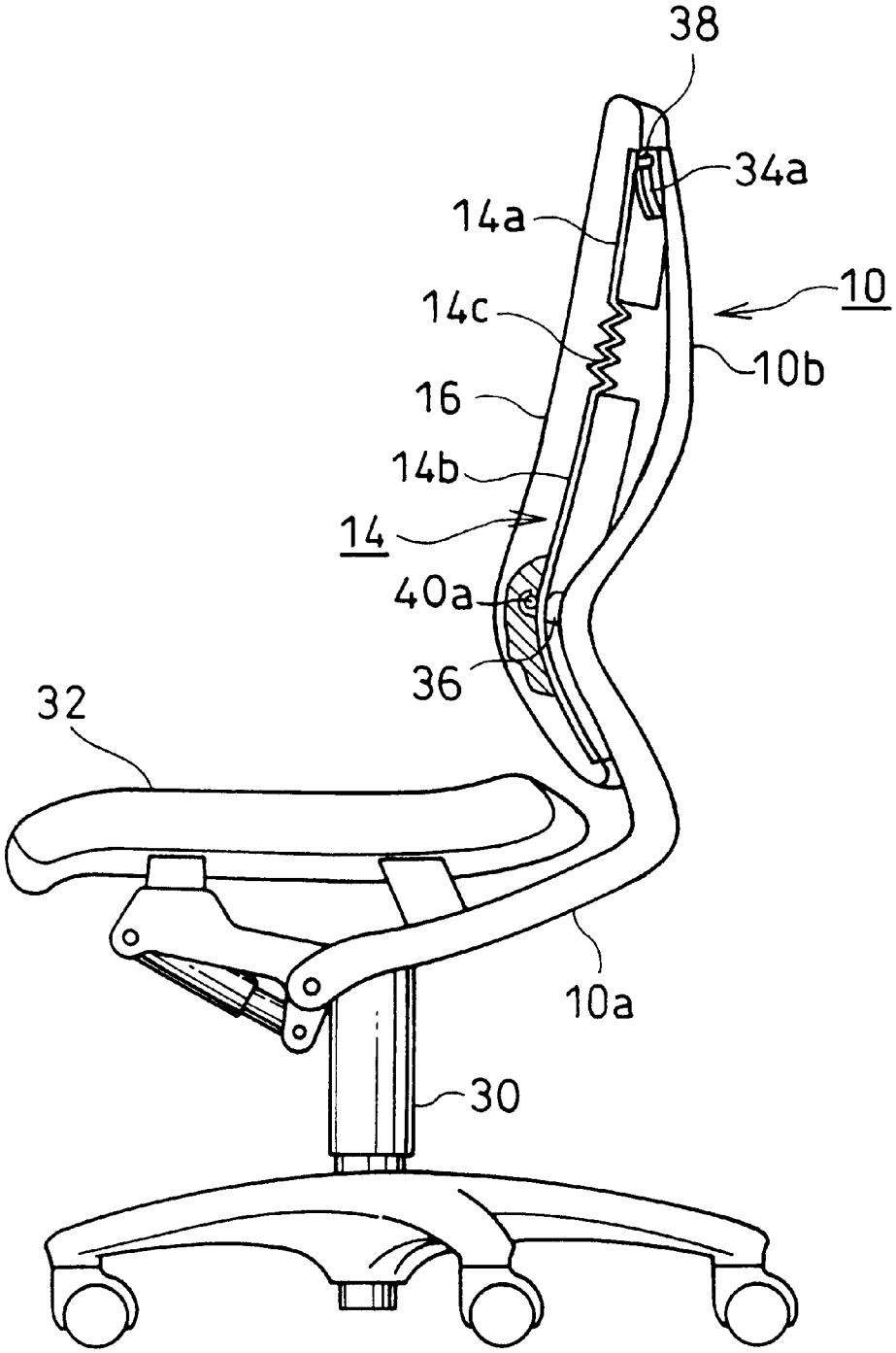
FIG. 8 is a side elevational view of the chair in upright posture.
Figure 9:
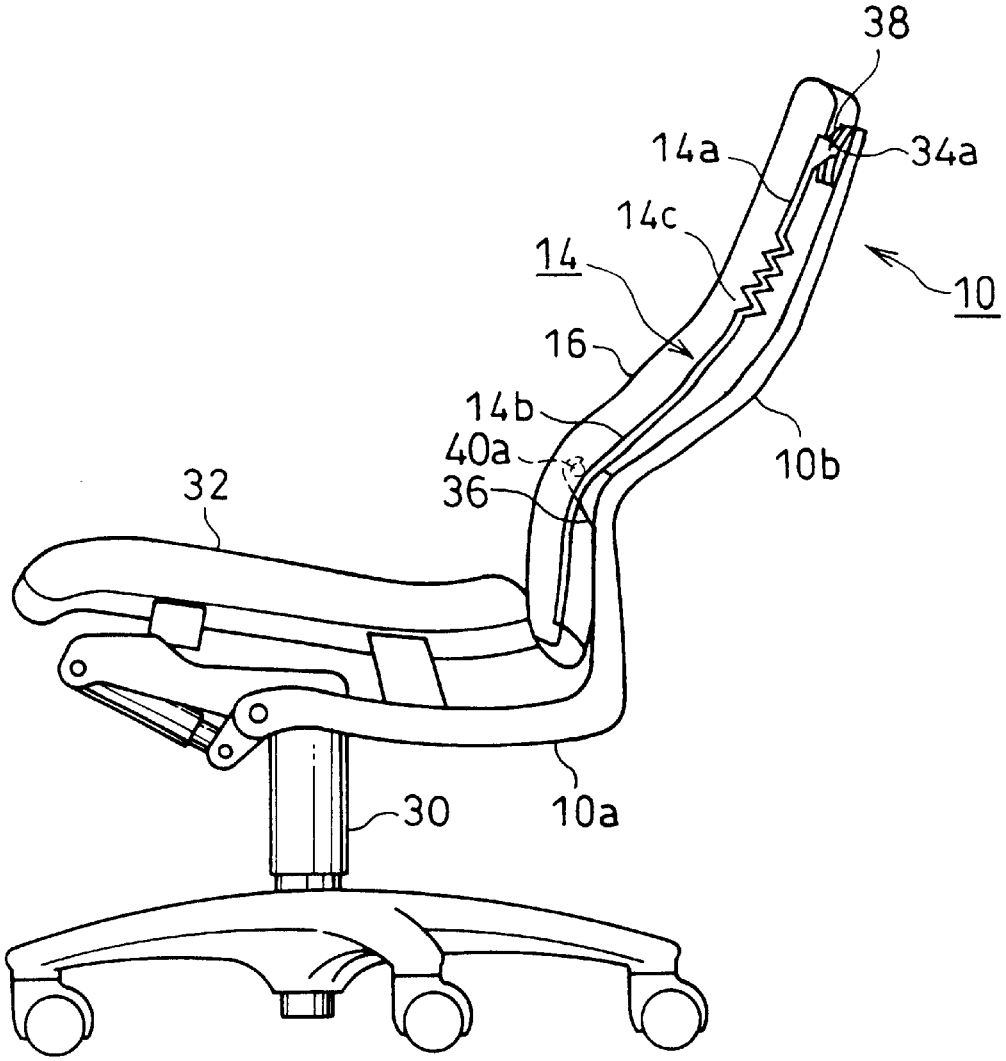
FIG. 9 is a side elevational view of the chair in rearward-inclined posture.

FIGS. 7 to 9 illustrate the second embodiment of the present invention. The same numerals are allotted to the same members as those in the first embodiment. A back frame 10 in the second embodiment comprises a pair of rods made of metal or rigid synthetic resin. The horizontal rod portion 10*a* extends forwards, and its end is mounted to a support 30, i.e. back seat synchro-reclining mechanism, and the frame 10 can be inclined backwards around the support 30. A pair of vertical rod portions 10*a* is bent at two points. The upper part is bent rearwards, and the lower part is bent forwards. Mounting portions 34 which have sliding groove 34 are fixed on the front surfaces of the upper ends of the vertical rod portions 10*b*. A sliding groove 34*a* has a front convex surface, and upper and outer sides are opened. On the front surface of the lower bent portion of the vertical rod portions 10*b*, a horizontal bearing 36 which has an upper opening is fixed. A back plate 14 is made of elastic rigid synthetic resin molding, and comprises an upper shell 14*a* and a lower shell 14*b*.

A boundary between the upper and lower shells 14*a* and 14*b* has the same height as the upper bent portion. This position is corresponding to a boundary between the theracic and lumbar vertebraes of a human body. Between the upper and lower shells 14*a* and 14*b,* a pair of wavelike portions 14*c* is provided. In the embodiment, the wavelike portions 14*c* are integrally molded with the upper and lower shells 14*a* and 14*b,* but may be separately made therefrom. The number of the bent portions 14*c* is not limited to two, but may be over two.

At the upper end of the upper shell 14*b,* a sliding portion 38 is formed and engaged in the slide groove 34*a* of the vertical rod portion 10*b.*

At each side of the lower shell 14*b,* an opening 40 is formed at a position corresponding to the horizontal bearing 36 of the vertical rod portion 10*b.* A horizontal shaft 40*a* is mounted over the opening 40.

To assemble the chair, the sliding portion 38 of the upper shell 14*a* is engaged in the sliding groove 34*a* of the upper rod portion 10*b,* and the horizontal shaft 40*a* of the lower shell 14*b* is engaged in the horizontal bearing 36 of the vertical rod portion 10*b* and elastically held. Thus, the back frame 10 is mounted to the back plate 14. Then, a back cushion material 16 is mounted to the front and rear surfaces of the back plate 14 by predetermined means to form the back of the chair. In FIGS. 7 to 9, the back cushion material mounted to the rear surface of the back plate 14 is not shown.

It will be described how to act with respect to FIGS. 8 and 9. From a position wherein a person sits at upright posture in FIG. 8, the back is pushed by the back of the person and the back is all inclined to reclining posture, and then, the back frame 10 is inclined rearwards by backward force around a fulcrum near a support 30 of the frame 10 in FIG. 9.

Backward force is applied by the back of the person to the lower portion of the upper shell 14*a* and the upper portion of the lower shell 14*b,* and as shown in FIG. 9, the wavelike portion 14*c* is elastically bent slightly so that an angle between the upper and lower shells 14*a* and 14*b* becomes smaller, so that the lower shell 14*b* is further inclined rearwards with respect to the back frame 10, and the upper shell 14*a* is inclined forwards with respect to the back frame 10 and the lower shell 14*b.* Actually, the upper shell 14*a* is gently inclined rearwards at a smaller angle than the backward inclination angle of the back frame 10 and the lower shell 14*b.*

The horizontal shaft 40*a* supported by the horizontal bearing 36 is rotated together with the lower shell 14*b* at the position, and the engagement portion 38 of the upper shell 14*a* is lowered along the sliding groove 34*a* by length in which the back plate 14 is bent and decreased. Other function and advantages are similar to those in the first embodiment.

Figure 10:
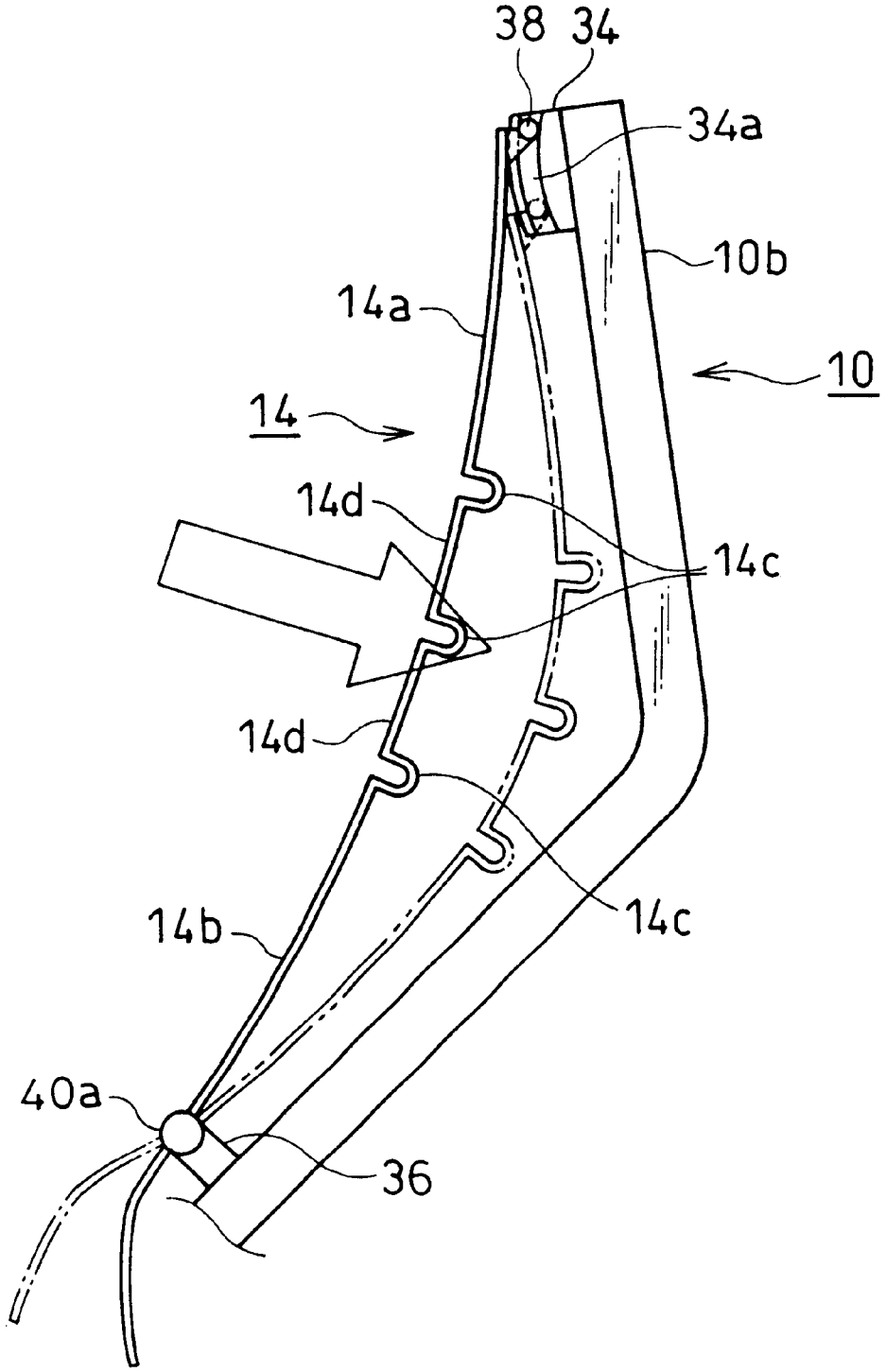
FIG. 10 is a schematic view of the third embodiment of the chair.

FIG. 10 illustrates the third embodiment of a chair according to the present invention. In this embodiment, a back plate 14 comprises an upper shell 14*a,* a lower shell 14*b* and two intermediate shells 14*d.* The number of the intermediate shell may be one or over. A horizontal shaft 38 at the upper end of the upper shell 14*a* is mounted so that it may be vertically slid and may be slightly inclined in a horizontal direction. The lower end of the lower shell 14*b* is pivotally mounted to a horizontal bearing 36 at the lower end of the back frame 10 by a horizontal shaft 40*a* so that it may be slightly inclined in a horizontal direction. The upper shell 14*a* is connected to the intermediate shell 14*d* by a U-shaped member 14*c* and the intermediate shell 14*d* is connected to the lower shell 14*b* by a U-shaped member 14*c.* The U-shaped member 14*c* is elastically bendable.

In the third embodiment, the back of a chair is bent in an almost arcuate form to fit with the back of a sitting person, thereby providing comfortable situation. Other structure and advantages are similar to those in the first embodiment.

Figure 11:
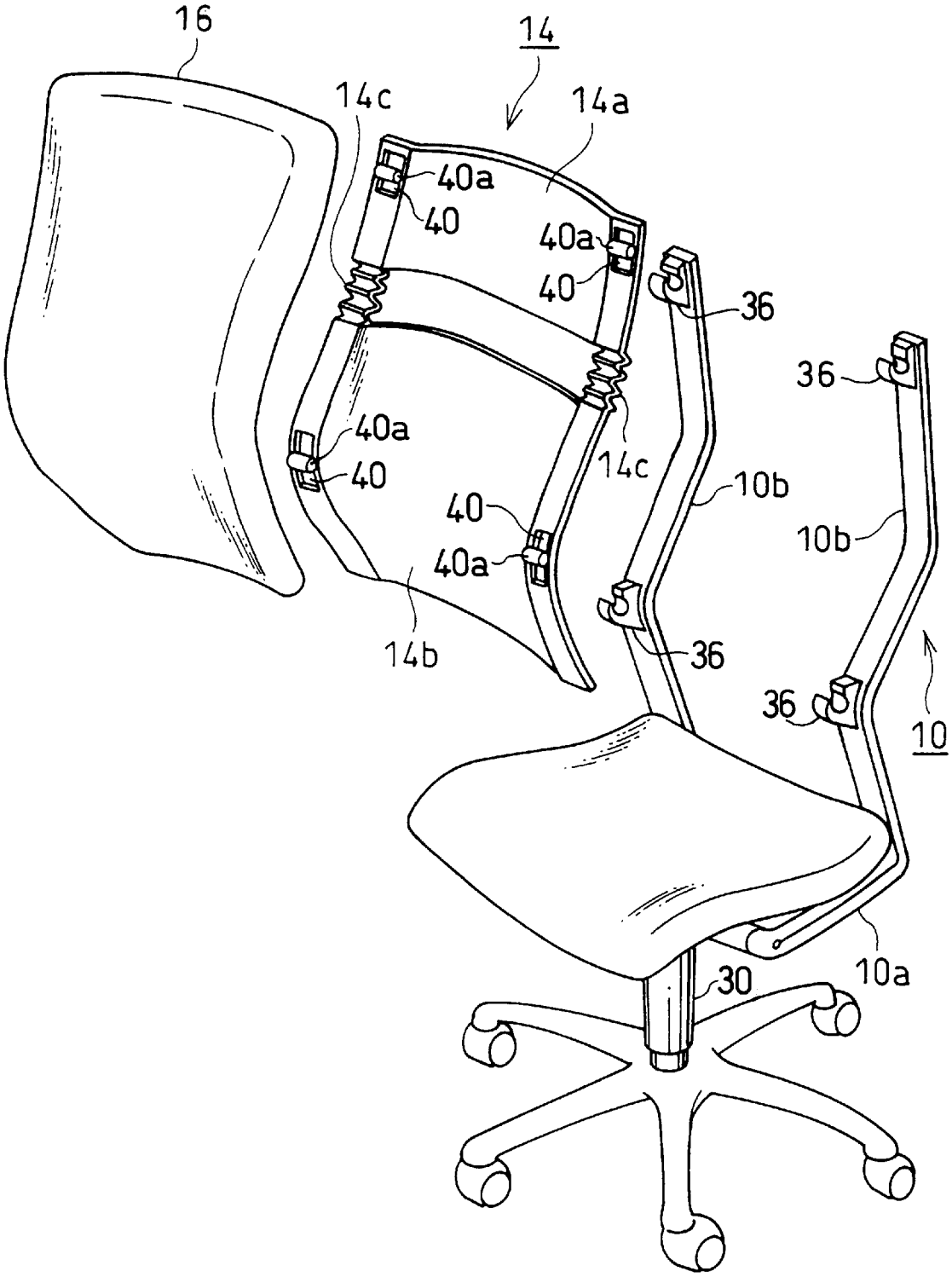
FIG. 11 is an exploded perspective view of the fourth embodiment a chair according to the present invention.

FIG. 11 illustrates the fourth embodiment of a chair according to the present invention, which is the same as the second embodiment in FIG. 7, except that a back plate 14 has a horizontal shaft 40*a* over an opening 40 at the upper end, and that a back frame 10 has a horizontal bearing 36 at the upper end as well as the lower portions.

Figure 12:
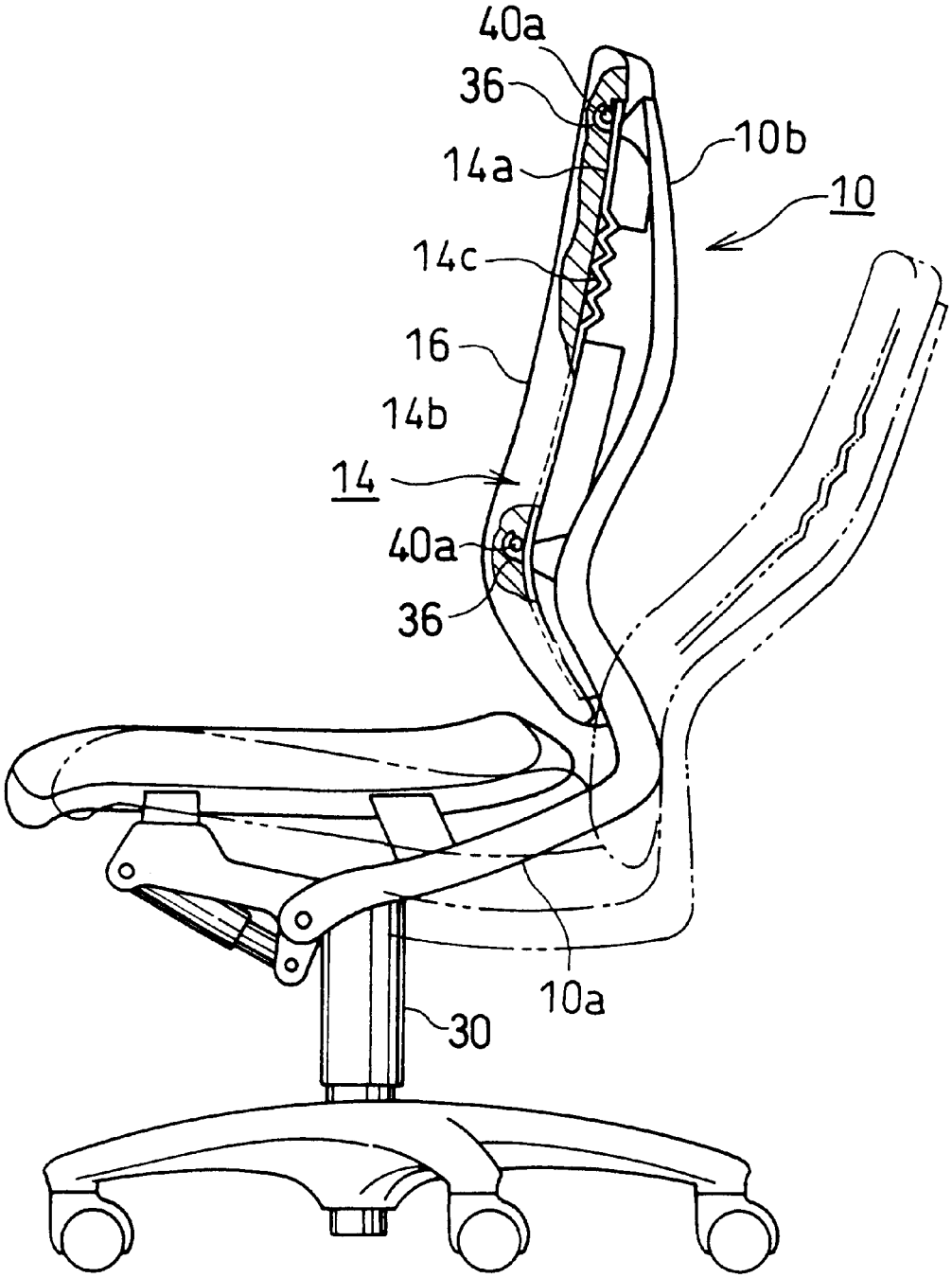
FIG. 12 is a side elevational view thereof.
Figure 13:
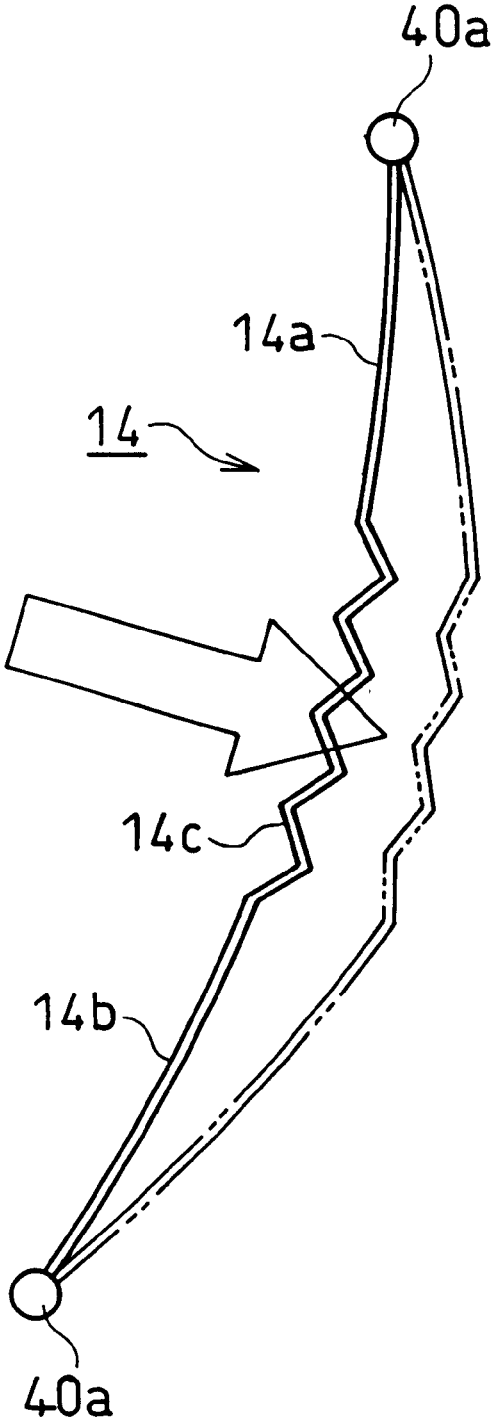
FIG. 13 a view which shows function of the chair.

The chair in the embodiment will be operated as shown in FIGS. 12 and 13. As illustrated in FIG. 12, the back of the chair is pushed rearwards by the back of a sitting person from upright sitting posture and inclined to reclining posture as shown by two-dotted lines. The back frame 10 is inclined rearwards around a fulcrum near a support 30 by backward force which acts to a back plate 10.

A lower portion of an upper shell 14*a* and an upper portion of a lower shell 14*b* are subjected to backward force by the back of the sitting person respectively. As shown by two-dotted lines in FIG. 13, a waveform of a wavelike portion 14*c* is elastically flattened to open its waveform, and an angle between the upper and lower shells 14*a* and 14*b* becomes smaller. Therefore, the lower shell 14*b* is further inclined rearwards with respect to the back frame 10, and the upper shell 14*a* is inclined forwards with respect to the back frame 10 and the lower shell 14*b.* Actually, the upper shell 14*a* is gently inclined rearwards at a smaller angle than rearward inclining angle of the back frame 10 and the lower shell 14*b.*

The horizontal shafts 40*a* supported by upper and lower horizontal bearings 18 are rotated together with the upper and lower shells 14*a* and 14*b.*

Figure 14:
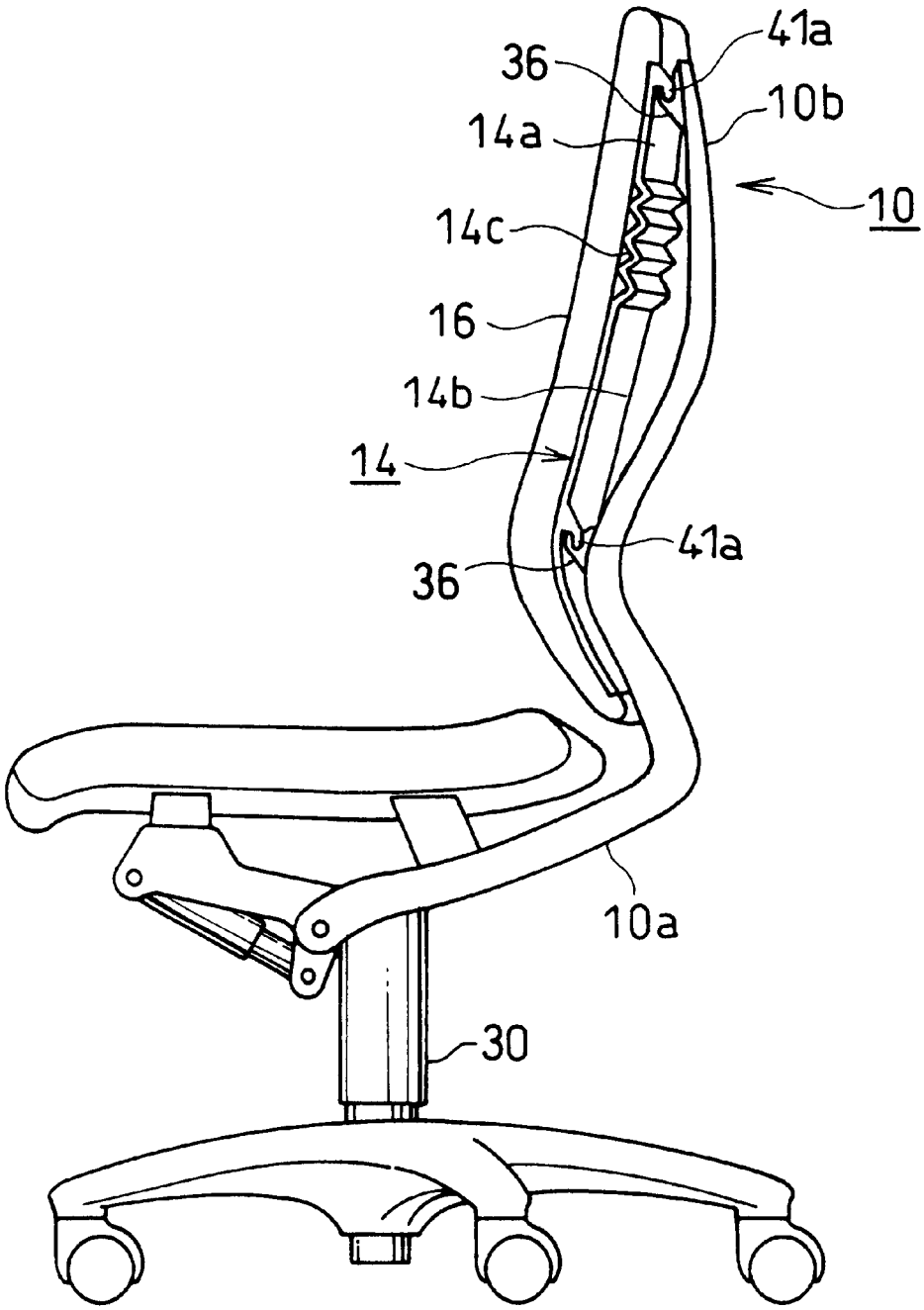
FIG. 14 is a side elevational view of the fifth embodiment of a chair according to the present invention.
Figure 15:
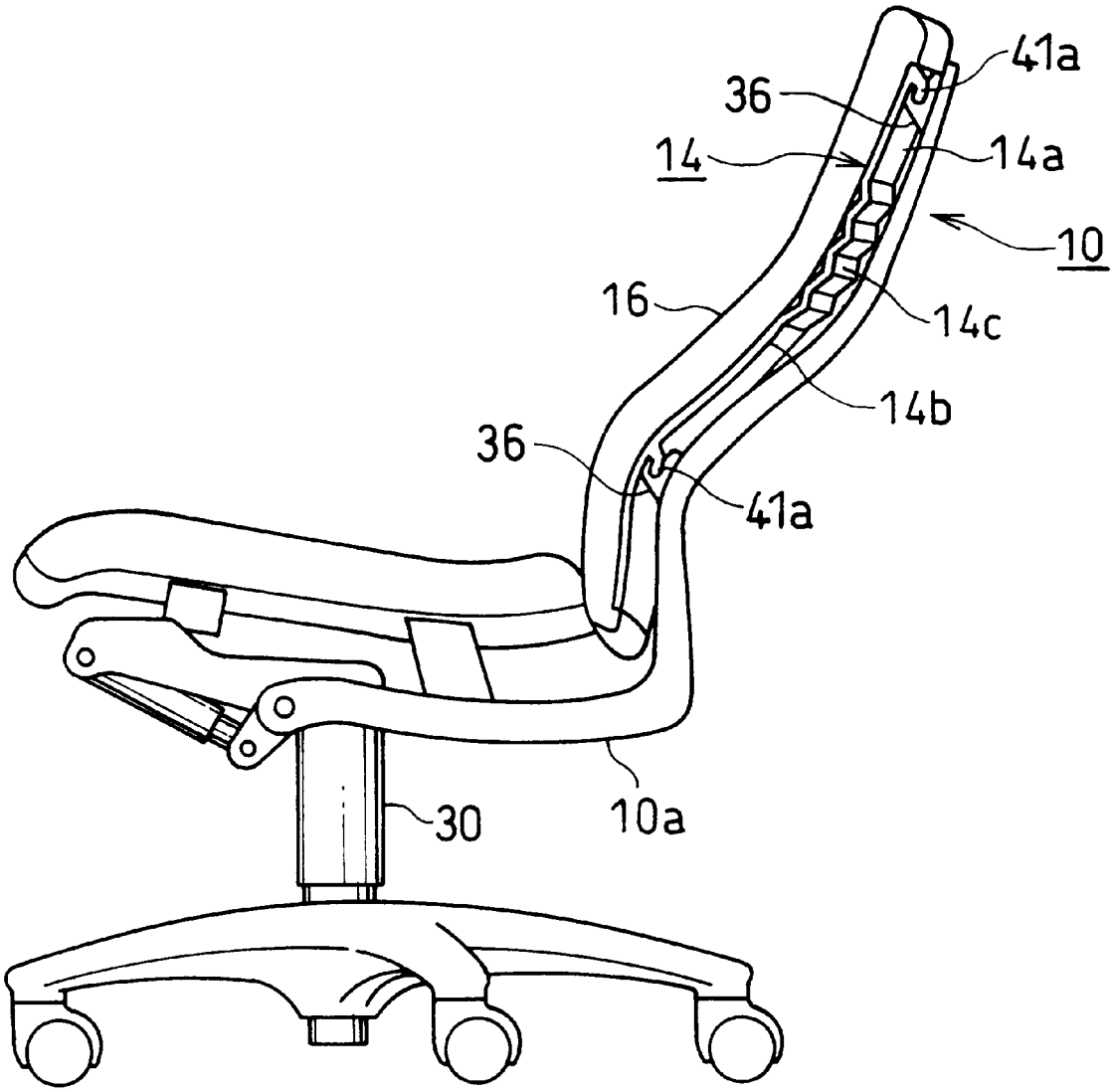
FIG. 15 is a side elevational view of the chair in reclining posture.

In the fifth embodiment of a chair according to the present invention as shown in FIGS. 14 and 15, an upper shell 14*a* is connected with a lower shell 14*b* by a wavelike portion 14*c* which extends over all width of the upper and lower shells 14*a* and 14*b.* An engagement portion 41*a* integrally formed with the upper and lower shells 14*a,* 14*b* is projected rearwards and pivotally supported by a horizontal bearing 36 of a vertical rod portion 10*b* of a back frame 10. FIG. 15 illustrates reclining posture of the fifth embodiment.

Figure 16:
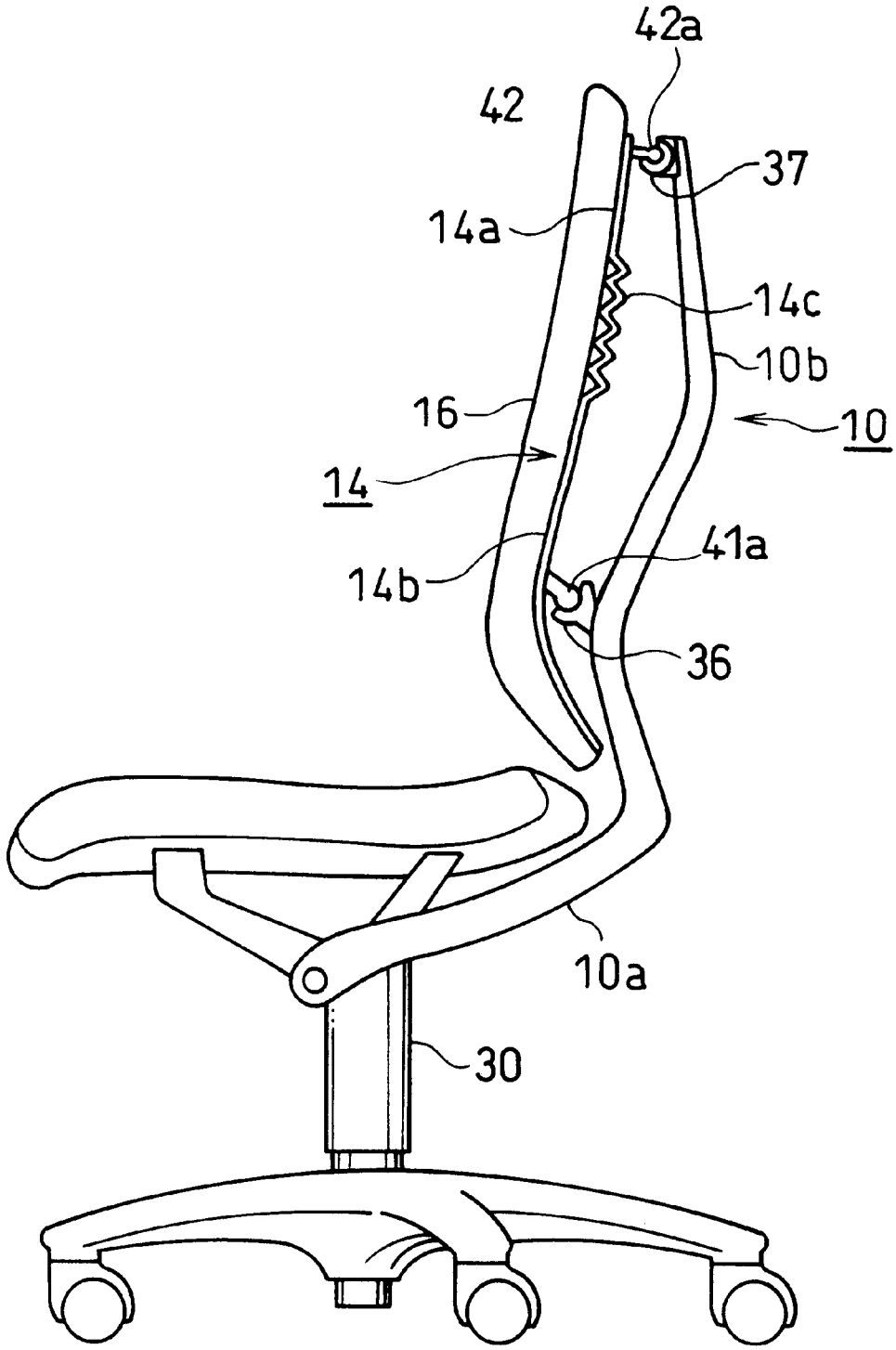
FIG. 16 is a side elevational view of the sixth embodiment of a chair according to the present invention.

In the sixth embodiment in FIG. 16, an upper horizontal bearing 37 of a vertical rod portion 10*b* of a back frame 10 has not an upper opening, and is pivotally engaged with a bracket 42 of an upper shell 14*a* of a back plate 14 by a horizontal shaft 42*a.*

Figure 17:
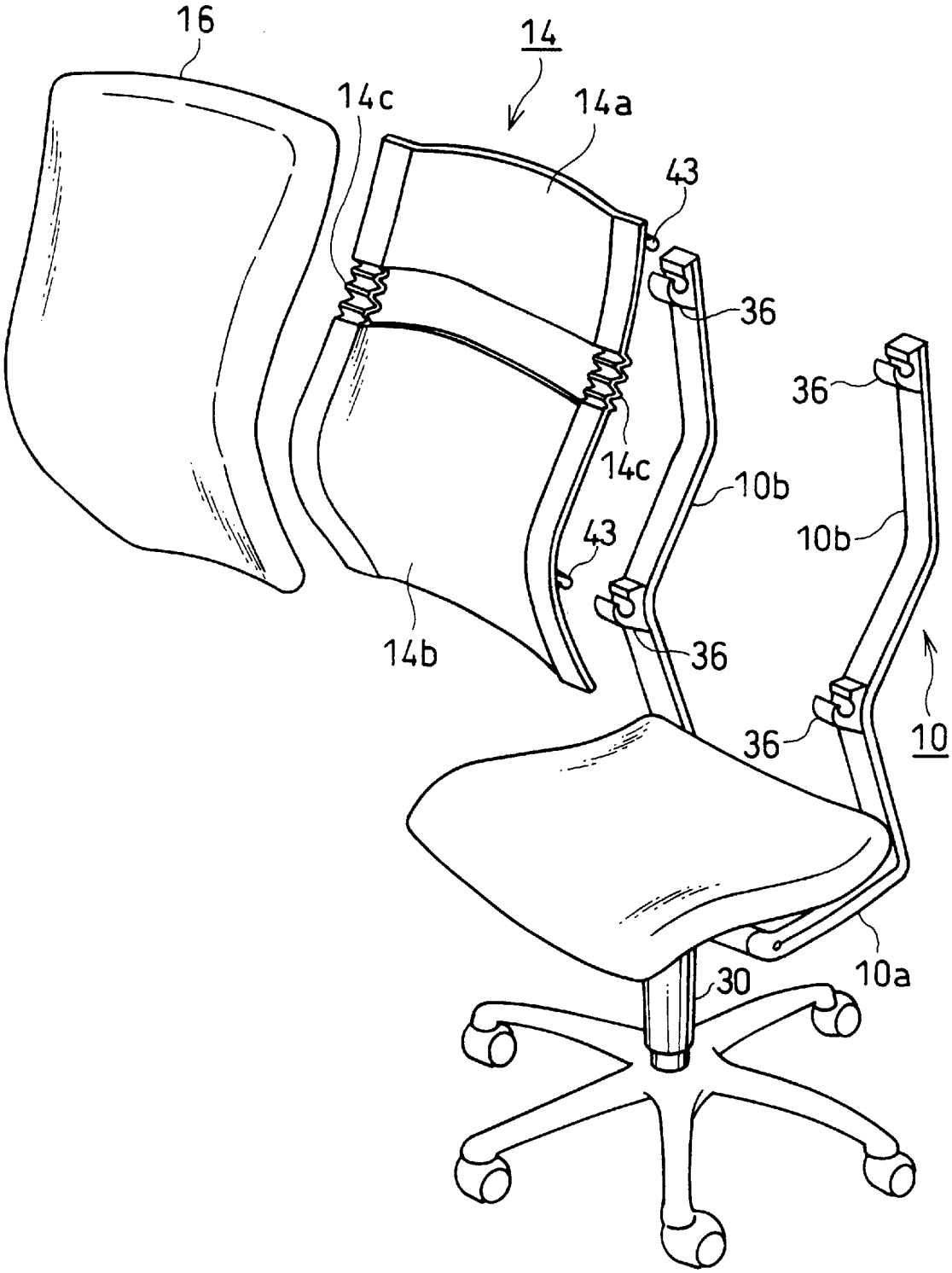
FIG. 17 is an exploded perspective view of the seventh embodiment of a chair according to the present invention.

The seventh embodiment is shown in FIG. 17. At the upper end of an upper shell 14*a* and at the lower portion of a lower shell 14*b,* a horizontal shafts 43 are mounted. The horizontal shaft 40 is engaged in a horizontal bearing 36 of a vertical rod portion 10*b* of back frame 10.

Figure 18:
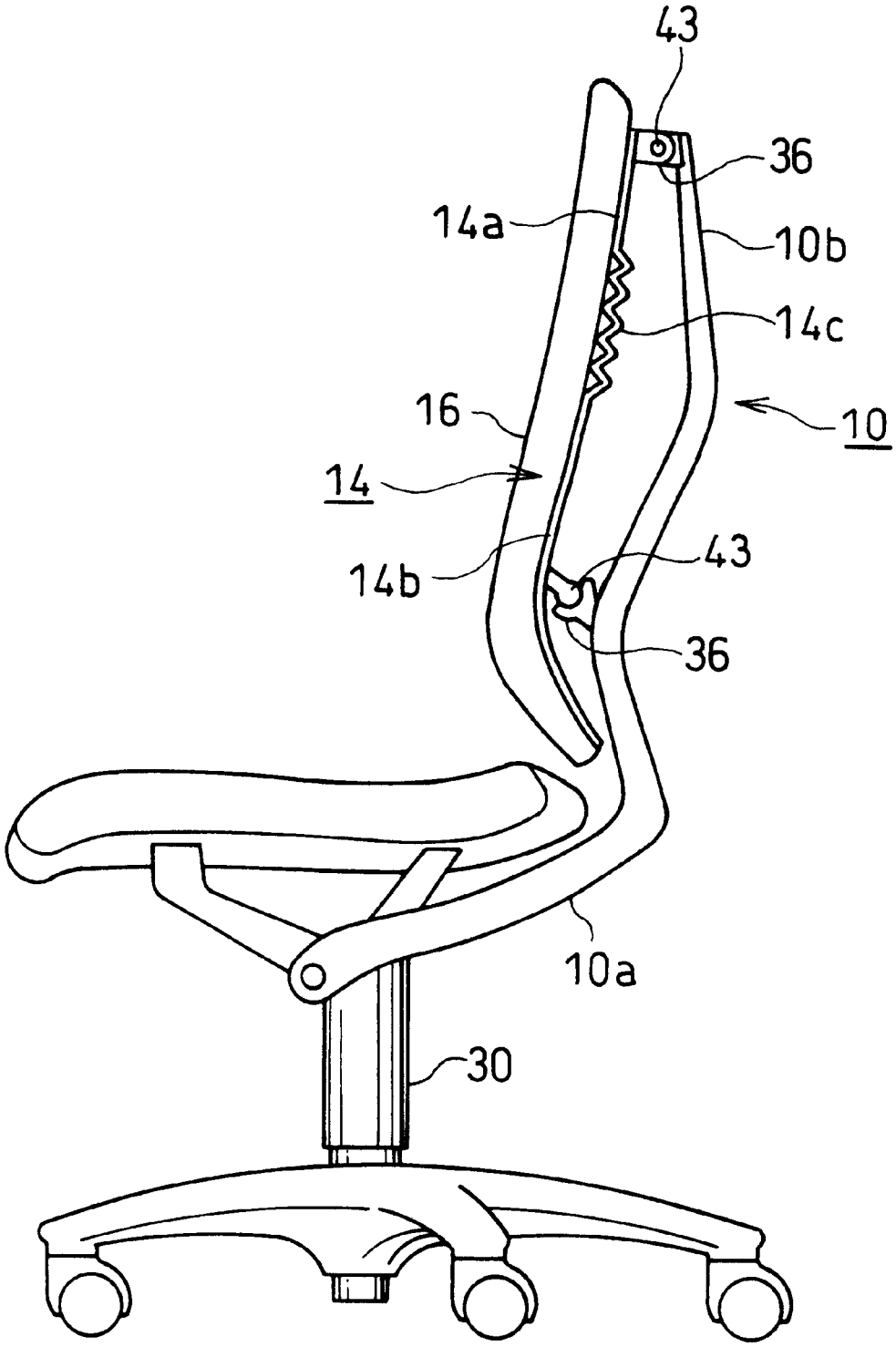
FIG. 18 is a side elevational view of the chair in upright position.
Figure 19:
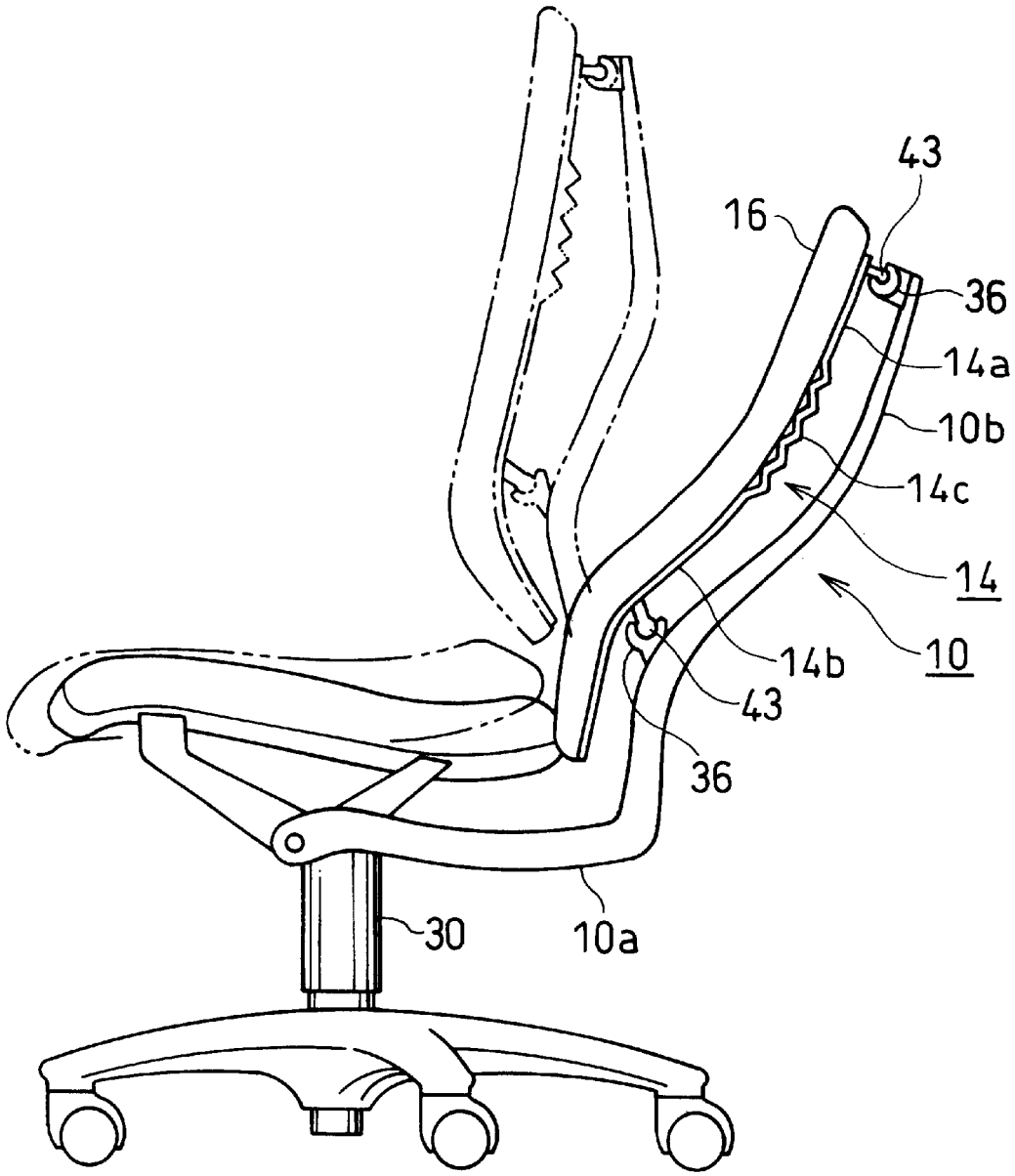
FIG. 19 is a side elevational view of the chair in rearward inclined position.

From upright sitting posture of a sitting person in FIG. 18, the back of a chair is pushed rearwards by the back of the person and inclined rearwards to reclining posture shown by solid lines in FIG. 19. A back frame 10 is inclined around a fulcrum near a support 30 by backward force which acts to a back plate 14.

The horizontal shaft 20 of the upper shell 14*a* may be engaged in a vertical sliding groove at the upper end of the vertical rod portion 10 *b* .

The foregoing merely relate to embodiment of the present invention. Various changes and modifications may be made by person skilled in the art without departing from the scope of claims wherein:

What is claimed is:

1. A chair which comprises:

a back frame; and a back plate which comprises upper and lower shells, an upper end of the upper shell and a lower portion of the lower shell being mounted to an upper end and a lower portion of said back frame, said upper shell being connected to said lower shell by a flexible bent portion, backward force being applied to the back plate when the chair is reclined, to move the upper shell forwards and the lower shell backwards, whereby an angle between the upper and lower shells may become smaller to keep posture of a sitting person suitable.

2. A chair as defined in claim 1 wherein the upper end of the upper shell or the lower portion of the lower shell is slidable with respect to the upper end or the lower portion of the back frame.

3. A chair as defined in claim 2 wherein the back frame has a bent vertical rod portion, the back plate having an elongate bore at an upper end, said vertical portion of the back frame having guide pin at an upper end, said guide pin being engaged in said elongate bore so that the back plate may be slid with respect to the back frame when the back plate is inclined backwards.

4. A chair as defined in claim 3 wherein a reinforcement member is provided between the back plate and the vertical rod portions of the back frame, having an elongate bore which is engagable with the guide pin of the back frame and having a bent portion which is engaged with the bent portion of the back plate.

5. A chair as defined in claim 1 wherein the back frame comprises a bent vertical rod portion and two horizontal rod portions integrally connected with the vertical rod portions, and two parallel cross rails for connecting the vertical rods portions to each other and connecting the horizontal rod portions to each other.

6. A chair as defined in claim 1 wherein the back plate is made of rigid synthetic resin by molding.

7. A chair as defined in claim 1 wherein said bent portion comprises a wavelike portion.

8. A chair as defined in claim 7 wherein said back plate has a first opening over which a first horizontal shaft is mounted, at a lower opening over which a first horizontal shaft is mounted, at a lower portion, and a second opening over which a second horizontal shaft is mounted, at an upper end, said back frame having a first bearing at lower portion and a second bearing at an upper end, said first horizontal shaft being engaged in said first bearing, said second horizontal shaft being engaged in said second bearing.

9. A chair as defined in claim 7 wherein said back plate has a first engagement portion which projects rearwards, at lower portion and a second engagement portion which projects rearwards, at an upper end, said back frame having a first bearing at a lower portion and a second bearing at an upper end, said first engagement portion being engaged in said first bearing, said second engagement portion being engaged in said second bearing.

10. A chair as defined in claim 7 wherein said wavelike portion extends at each side of the upper and lower shells.

11. A chair as defined in claim 7 wherein said wavelike portion extends over all width of said upper and lower shells.

12. A chair as defined in claim 7 wherein said back plate has a first horizontal shaft at a lower portion and a bracket which has a second horizontal shaft, at an upper end, said back frame having a first bearing at a lower portion and a second bearing at an upper end, said first horizontal shaft being engaged in first bearing, said first second horizontal shaft being engaged in said second bearing.

13. A chair as defined in claim 7 wherein said back plate has a first horizontal shaft which projects rearwards, at a lower portion and a second horizontal shaft which projects rearwards, at an upper end, said back frame having a first bearing at lower portion and a second bearing at an upper end, said first horizontal shaft being engaged in said first bearing, said second horizontal shaft being engaged in said second bearing.

14. A chair as defined in claim 1 wherein the back frame can be inclined around a fulcrum near a support of the chair.

15. A chair as defined in claim 1 wherein said back plate has an a horizontal shaft at a lower portion, and a sliding portion at an upper end, said back frame having a bearing at a lower portion and a sliding groove at an upper end, said horizontal shaft being engaged in said bearing, said sliding portion being engaged in said sliding groove so that said back plate may be slid with respect to said back frame.

16. A chair which comprises:

a back frame; and a back plate which comprises an upper shell, an intermediate shell and a lower shell, said upper shell being connected to said intermediate shell by a first flexible U-shaped portion, said intermediate portion being connected to said lower shell by a second flexible U-shaped portion so that the shells may be elastically bent to change an arc to that of a smaller circle when backward force is applied, said upper shell having a horizontal shaft at an upper end, said back frame having a sliding groove at an upper end, said horizontal shaft being engaged in said sliding groove of the back frame so that said back plate may be slid with respect to said back frame.

* * * * *